US010619643B2

(12) United States Patent
Tang et al.

(10) Patent No.: US 10,619,643 B2
(45) Date of Patent: Apr. 14, 2020

(54) CEILING FAN ASSEMBLY

(71) Applicants: GD MIDEA ENVIRONMENT APPLIANCES MFG CO., LTD., Zhongshan (CN); MIDEA GROUP CO., LTD., Foshan (CN)

(72) Inventors: Xinmin Tang, Zhongshan (CN); Shuisheng Lei, Zhongshan (CN); Yaoguang Liang, Zhongshan (CN)

(73) Assignees: GD MIDEA ENVIRONMENT APPLIANCES MFG. CO., LTD., Zhongshan (CN); MIDEA GROUP CO., LTD., Foshan (CN)

( * ) Notice: Subject to any disclaimer, the term of this patent is extended or adjusted under 35 U.S.C. 154(b) by 82 days.

(21) Appl. No.: 15/969,638

(22) Filed: May 2, 2018

(65) Prior Publication Data

US 2018/0252227 A1 Sep. 6, 2018

Related U.S. Application Data

(63) Continuation of application No. PCT/CN2016/079682, filed on Apr. 19, 2016.

(51) Int. Cl.

| | |
|---|---|
| ***F04D 29/00*** | (2006.01) |
| ***F04D 29/64*** | (2006.01) |
| ***F04D 25/08*** | (2006.01) |

(52) U.S. Cl.

CPC ..... *F04D 29/005* (2013.01); *F04D 25/088* (2013.01); *F04D 29/64* (2013.01)

(58) Field of Classification Search

CPC ..... F04D 29/005; F04D 25/088
USPC ..... 416/146 R
See application file for complete search history.

(56) References Cited

U.S. PATENT DOCUMENTS 4,548,554 A * 10/1985 Angott ..... H05K 5/0017 174/54
6,146,191 A * 11/2000 Kerr, Jr. ..... F04D 25/088 439/140
2004/0256531 A1* 12/2004 Tang ..... F04D 25/088 248/343

(Continued)

FOREIGN PATENT DOCUMENTS

| | | | | |
|---|---|---|---|---|
| AU | 2016403137 A1 | | 11/2017 | |
| CN | 2616728 Y | | 5/2004 | |
| CN | 2634162 Y | | 8/2004 | |
| CN | 204828072 U | * | 12/2015 | ..... F04D 29/64 |
| CN | 205013393 U | | 2/2016 | |

(Continued)

OTHER PUBLICATIONS

Midea Group Col. Ltd., Guangdong Midea Environment Appliances Manufacturing Co. Ltd., First Examination Report, NZ736645, dated Apr. 9, 2019, 5 pgs.

(Continued)

*Primary Examiner* — J. Todd Newton
(74) *Attorney, Agent, or Firm* — Morgan, Lewis & Bockius LLP

(57) ABSTRACT

A ceiling fan assembly (100) including a downrod (10); a ceiling fan (20) connected to a lower end of the downrod (10); a connector base (30) mounted to the downrod (10) and located above the ceiling fan (20); and a receiver (40) having an internal mounting groove (40*a*) penetrating the receiver (40) in an up-and-down direction, the receiver (40) being located at the periphery of a central axis of the downrod (10) and detachably connected to the connector base (30).

8 Claims, 5 Drawing Sheets

(56) References Cited

U.S. PATENT DOCUMENTS

| | | | | |
|---|---|---|---|---|
| 2011/0002783 | A1* | 1/2011 | Yamamoto | F04D 25/088 416/30 |
| 2013/0209293 | A1 | 8/2013 | Kawano et al. | |
| 2015/0090858 | A1* | 4/2015 | Broughman | F04D 25/088 248/674 |
| 2018/0112680 | A1* | 4/2018 | Tang | F04D 29/601 |
| 2018/0252227 | A1* | 9/2018 | Tang | F04D 25/088 |
| 2018/0347590 | A1* | 12/2018 | Beaman | F04D 29/646 |

FOREIGN PATENT DOCUMENTS

| | | | |
|---|---|---|---|
| CN | 205078475 | U | 3/2016 |
| CN | 105736475 | A | 7/2016 |
| CN | 205669511 | U | 11/2016 |
| EP | 3447310 | A1 | 2/2019 |
| WO | WO2017181347 | A1 | 10/2017 |

OTHER PUBLICATIONS

Midea, International Search Report and Written Opinion, PCT/CN2016/079682, dated Jan. 10, 2017, 13 pgs.

Guangdong Midea Environment Appliances Manufacturing Co. Ltd., First Office Action, CN201610247951.8, dated Aug. 25, 2017, 10 pgs.

Guangdong Midea Environment Appliances Manufacturing Co. Ltd., Second Office Action, CN201610247951.8, dated Jun. 21, 2018, 15 pgs.

Guangdong Midea Environment Appliances Manufacturing Co. Ltd., Office Action, CA2,984,823, dated Jun. 19, 2019, 4 pgs.

Guangdong Midea Environment Appliances Manufacturing Co. Ltd., Invitation to Respond to Written Opinion, SG11201709084X, dated Nov. 12, 2019, 8 pgs.

* cited by examiner

CEILING FAN ASSEMBLY

PRIORITY CLAIM AND RELATED APPLICATION

This application is a continuation application of PCT/CN2016/079682, entitled "CEILING FAN ASSEMBLY" filed on Apr. 19, 2016.

TECHNICAL FIELD

The present disclosure relates to a technical field of electric appliances, and more particularly to a ceiling fan assembly.

BACKGROUND

In the related art, a mounting structure for a circuit board of a decorative ceiling fan mostly adopts a separate receiver disposed on the top of a downrod, and is then wired through a wiring cap. But such structure is inconvenient to operate and the wire arrangement thereon is cumbersome. Additionally, since the receiver is directly hung across the downrod and might fall off during the operation of the ceiling fan, resulting in operation faults of the ceiling fan, poor user experience, and low operating sense.

SUMMARY

Embodiments of the present disclosure seek to solve at least one of the problems existing in the related art to at least some extent. Accordingly, the present disclosure provides a ceiling fan assembly that has a simple structure and is low cost, convenient to assemble and disassemble, reliable in connection of various components, stable in system operation and good in user experience.

The ceiling fan assembly according to embodiments of the present disclosure includes: a downrod; a ceiling fan connected to a lower end of the downrod; a connector base mounted to the downrod and located above the ceiling fan; and a receiver having an internal mounting groove penetrating the receiver in an up-and-down direction, the receiver being located at a periphery of a central axis of the downrod and detachably connected to the connector base.

In the ceiling fan assembly according to embodiments of the present disclosure, by providing the receiver to the downrod and locating the receiver at the periphery of the central axis of the downrod, and then connecting the receiver to the connector base provided to the downrod, it is possible to ensure reliability of the connection of the receiver and to prevent the receiver from falling off during operation of the ceiling fan, thereby ensuring the operational reliability and safety of the ceiling fan. The ceiling fan assembly is simple in structure, reliable in connection among various components, convenient to assemble and disassemble, high in safety, and good in user experience.

In addition, the ceiling fan assembly according to embodiments of the present disclosure can further have the following technical features.

According to an embodiment of the present disclosure, the receiver comprises: a receiver body defining an avoidance groove with an opening; and a receiver cover disposed to a side of the receiver body to close an opening of the avoidance groove and cooperating with the receiver body to define the mounting groove, the receiver cover being connected to the receiver body in a snapping manner.

According to an embodiment of the present disclosure, side walls of the avoidance groove are provided with a plurality of fixing plates spaced apart along a circumference of the avoidance groove; each of the fixing plates is provided with a respective first mounting hole; and the connector base is provided with a plurality of second mounting holes each in a one-to-one correspondence with a corresponding first mounting hole.

According to an embodiment of the present disclosure, the avoidance groove is approximately ⊏-shaped; three side walls of the avoidance groove are provided with the fixing plates extending inwards in a radial direction of the downrod; and the fixing plates are connected to the connector base.

According to an embodiment of the present disclosure, opposite side walls of the avoidance groove which are adjacent to the opening are respectively provided with a terminal interface for connection with an external circuit.

According to an embodiment of the present disclosure, the receiver body and the connector base are connected by a screw.

According to an embodiment of the present disclosure, the receiver body is approximately U-shaped, and an outer contour of the receiver body is formed to be arc-shaped.

According to an embodiment of the present disclosure, a top wall of the receiver body is provided with a vertical baffle extending along the circumference of the avoidance groove, and each fixing plate is connected to an upper end of the vertical baffle.

According to an embodiment of the present disclosure, two ends of the vertical baffle, adjacent to the opening, are provided respectively with a snap groove, and the receiver cover is provided with a snap snapped into the snap groove.

According to an embodiment of the present disclosure, an outer contour line of the receiver is formed as a circle.

Additional aspects and advantages of embodiments of the present disclosure will be given in part in the following descriptions, become apparent in part from the following descriptions, or be learned from the practice of the embodiments of the present disclosure.

REFERENCE NUMERALS

Figure 1:
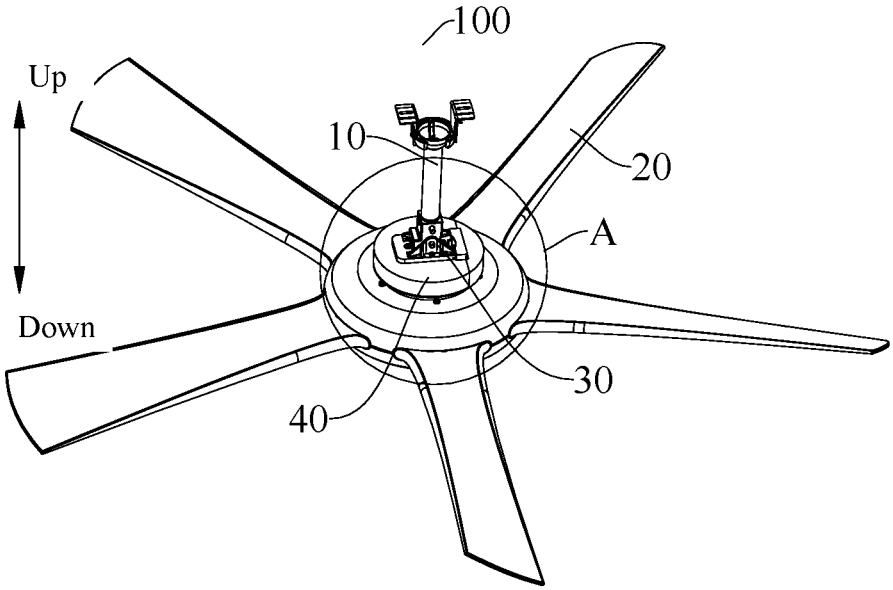
FIG. 1 is a schematic view of a ceiling fan assembly according to an embodiment of the present disclosure.

100 ceiling fan assembly;
10 downrod;

20 ceiling fan;

30 connector base; 30*a* second mounting hole;

40 receiver; 40*a* mounting groove; 41 receiver body; 41*a* avoidance groove; 411 vertical baffle; 4111 snap groove; 412 fixing plate; 412*a* first mounting hole; 413 terminal interface; 42 receiver cover.

DETAILED DESCRIPTION

Embodiments of the present disclosure will be described below, and examples of the embodiments are shown in the drawings. The embodiments described with reference to the drawings are illustrative, and used to generally understand the present disclosure rather than construed to limit the present disclosure.

A ceiling fan assembly 100 according to embodiments of the present disclosure will be described in detail with reference to FIGS. 1 to 10.

Figure 2:
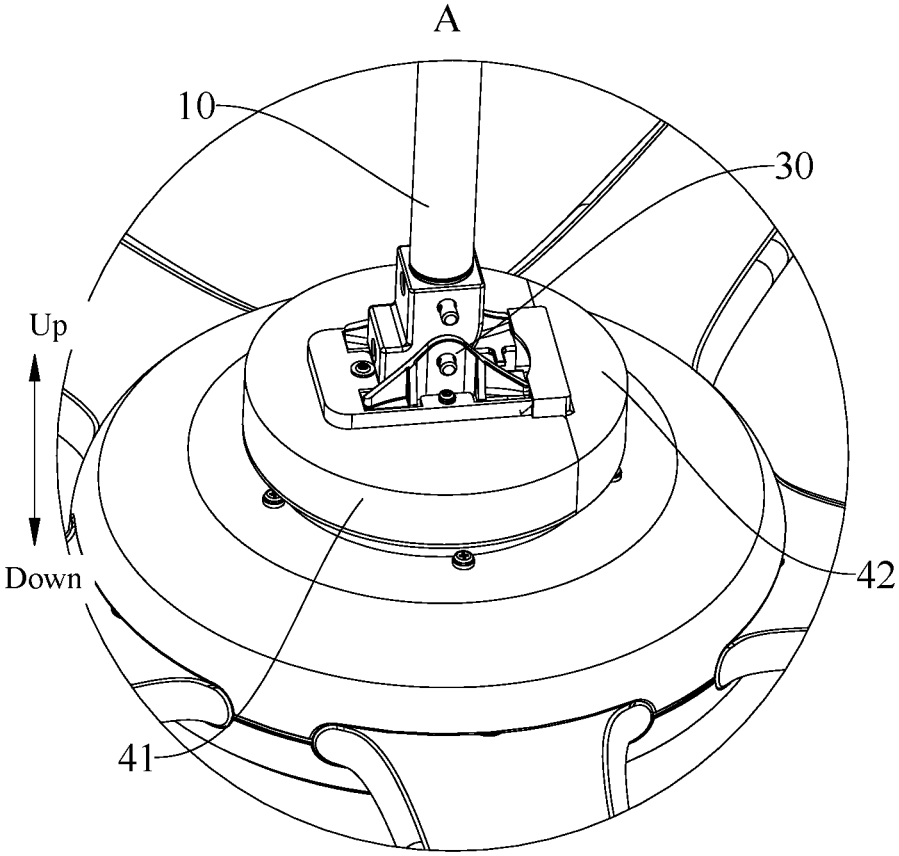
FIG. 2 is an enlarged view of part A in FIG. 1.

As shown in FIGS. 1 and 2, the ceiling fan assembly 100 includes a downrod 10, a ceiling fan 20, a connector base 30, and a receiver 40. Specifically, the ceiling fan 20 is connected to a lower end of the downrod 10. The connector base 30 is mounted to the downrod 10 and located above the ceiling fan 20. The receiver 40 defines a mounting groove 40*a* penetrating the receiver 40 in an up-and-down direction, and the receiver 40 is located at the periphery of a central axis of the downrod 10 and detachably connected to the connector base 30.

In other words, the ceiling fan assembly 100 is mainly composed of the downrod 10, the ceiling fan 20, the connector base 30 and the receiver 40. The downrod 10 is formed as a columnar shape extending along a vertical direction (i.e. the up-and-down direction in FIG. 1). The ceiling fan 20 is connected to the lower end of the downrod 10 and can rotate around the central axis of the downrod 10. The lower end of the downrod 10 is provided with the connector base 30, and the connector base 30 is fitted over the downrod 10 and located above the ceiling fan 20.

Further, the receiver 40 internally defines the mounting groove 40*a* penetrating the receiver 40 in the up-and-down direction. The receiver 40 is disposed to a lower part of the downrod 10 and spaced apart from the lower end of the downrod 10. The receiver 40 is fixedly connected to the connector base 30 through a connecting structure on a side wall of the mounting groove 40*a* located in the middle of the receiver 40, so as to guarantee fixation and installation of the receiver 40. After the ceiling fan assembly 100 is assembled, the receiver 40 is located at the periphery of the central axis of the downrod 10 and connected to the connector base 30, so as to guarantee stability of the installation of the receiver 40.

Therefore, in the ceiling fan assembly 100 according to embodiments of the present disclosure, by providing the receiver 40 to the downrod 10 and locating the receiver 40 at the periphery of the central axis of the downrod 10, and then connecting the receiver 40 to the connector base 30 provided to the downrod 10, it is possible to achieve reliability of the connection of the receiver 40 and to prevent the receiver 40 from falling off during operation of the ceiling fan 20, thereby ensuring the operational reliability and safety of the ceiling fan 20. The ceiling fan assembly 100 is simple in structure, reliable in connection among various components, convenient to assemble and disassemble, high in safety, and good in user experience.

According to an embodiment of the present disclosure, the receiver 40 includes a receiver body 41 and a receiver cover 42. Specifically, an avoidance groove 41*a* with an opening (a front side shown in FIG. 10) is defined in the receiver body 41, the receiver cover 42 is disposed to a side (a front side shown in FIG. 10) of the receiver body 41 to close the opening of the avoidance groove 41*a* and cooperates with the receiver body 41 to define the mounting groove 40*a*, and the receiver cover 42 is connected to the receiver body 41 in a snapping manner.

That is, the receiver 40 is mainly comprised of the receiver body 41 and the receiver cover 42. The receiver body 41 has the avoidance groove 41*a* with an opening, and the receiver cover 42 is provided to the side of the receiver body 41 to close the opening of the avoidance groove 41*a*, such that the mounting groove 40*a* that penetrates in the up-and-down direction but is closed at periphery is defined between the receiver body 41 and the receiver cover 42.

Specifically, during the installation of the receiver 40, the receiver body 41 is first mounted to the connector base 30 and the downrod 10 is located in the avoidance groove 41*a* of the receiver body 41; after the receiver body 41 and the connector base 30 are fixedly connected, the receiver cover 42 is snap-fitted with the side of the receiver body 41 to close the opening of the avoidance groove 41*a* of the receiver body 41; finally, the central axis of the downrod 10 is located in the mounting groove 40*a* of the receiver 40, that is, the receiver 40 is fitted over the connector base 30 at the lower end of the downrod 10.

Therefore, the receiver body 41 has the avoidance groove 41*a* with the opening, thereby facilitating the installation of the receiver body 41 and the connection between the receiver body 41 and the connector base 30, moreover the receiver cover 42 can close the opening of the avoidance groove 41*a* to make the receiver 40 form an annular structure. In such a way, an aesthetic appearance of the receiver 40 can be achieved, and the reliability of the connection between the receiver 40 and the connector base 30 can be ensured to prevent the receiver 40 from falling off the downrod 10, thereby ensuring the safety and reliability.

According to an embodiment of the present disclosure, side walls of the avoidance groove 41*a* are provided with a plurality of fixing plates 412 spaced apart along a circumference of the avoidance groove 41*a*. Each of the fixing plates 412 is provided with a respective first mounting hole 412*a*, and the connector base 30 is provided with a plurality of second mounting holes 30*a* in one-to-one correspondence with the first mounting holes 412*a*. The ceiling fan assembly 100 further includes a plurality of fastening pieces, and the plurality of fastening pieces pass through the first mounting holes 412*a* of the fixing plates 412 and the second mounting holes 30*a* of the connector base 30 which are corresponding to the first mounting holes 412*a*, so as to guarantee a fixed connection between the receiver body 41 and the connector base 30, facilitate the connection and the assembly and disassembly, and prevent the receiver 40 from falling off, thereby avoiding the failure of the ceiling fan 20 during the operation and guaranteeing safe and reliable operation.

In some specific embodiments of the present disclosure, the avoidance groove 41*a* is approximately ⊏-shaped, three side walls of the avoidance groove 41*a* are provided with the fixing plates 412 extending inwards in a radial direction of the downrod 10, and the fixing plates 412 are connected to the connector base 30.

Figure 3:
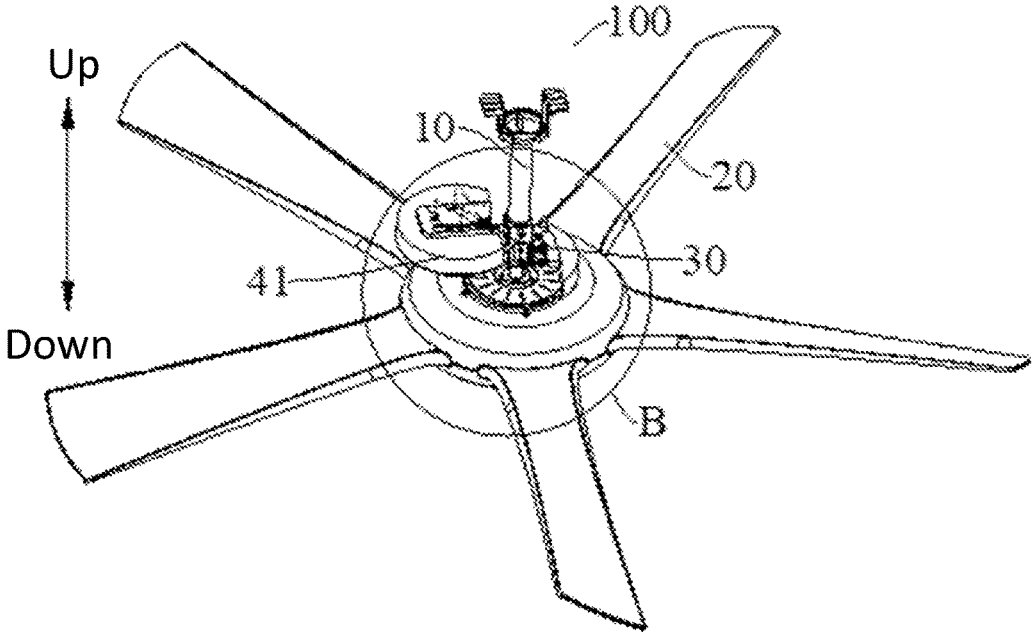
FIG. 3 is an exploded view of a receiver body and other components of a ceiling fan assembly according to an embodiment of the present disclosure.
Figure 4:
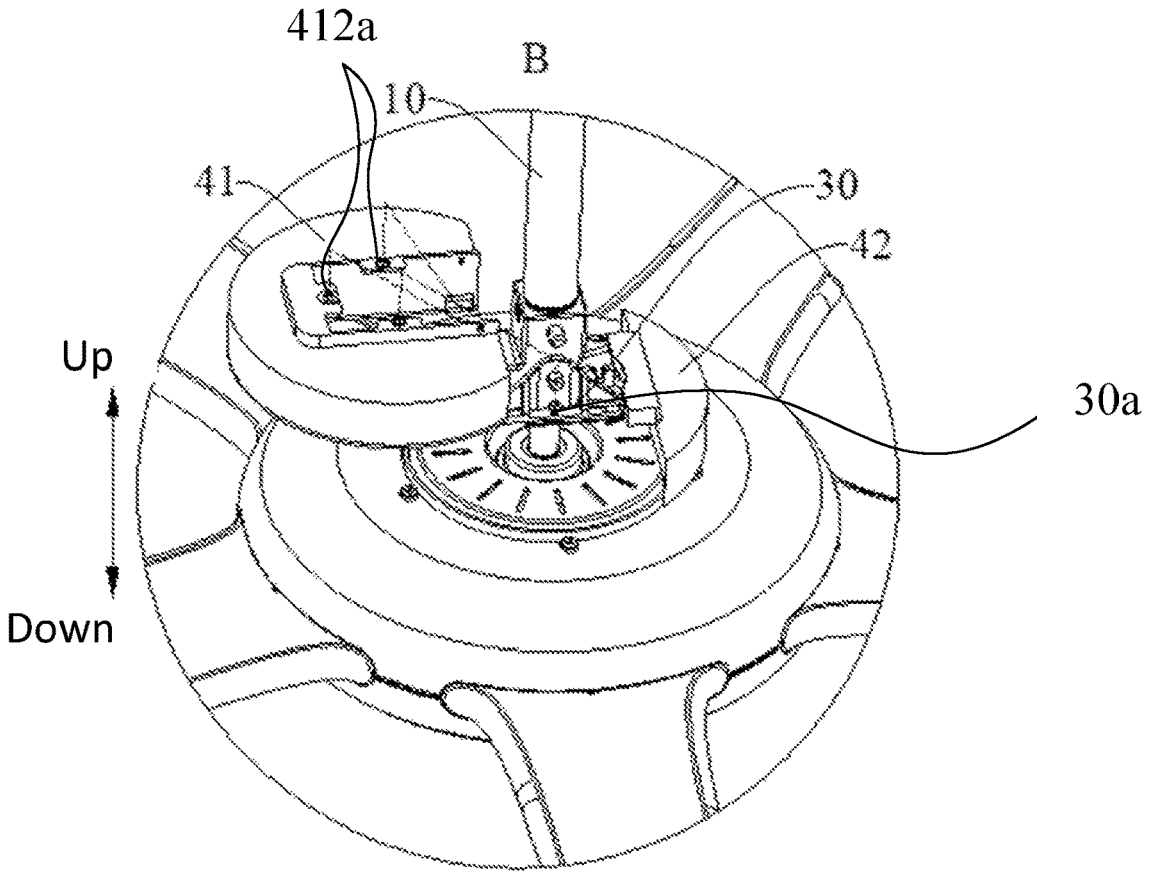
FIG. 4 is an enlarged view of part B in FIG. 3.
Figure 5:
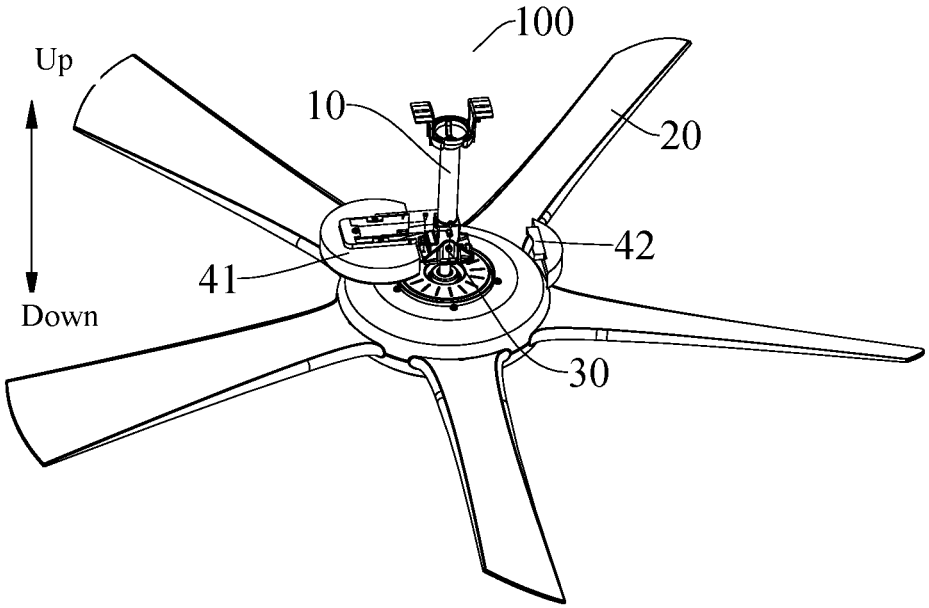
FIG. 5 is an exploded view of the ceiling fan assembly in FIG. 1.
Figure 6:
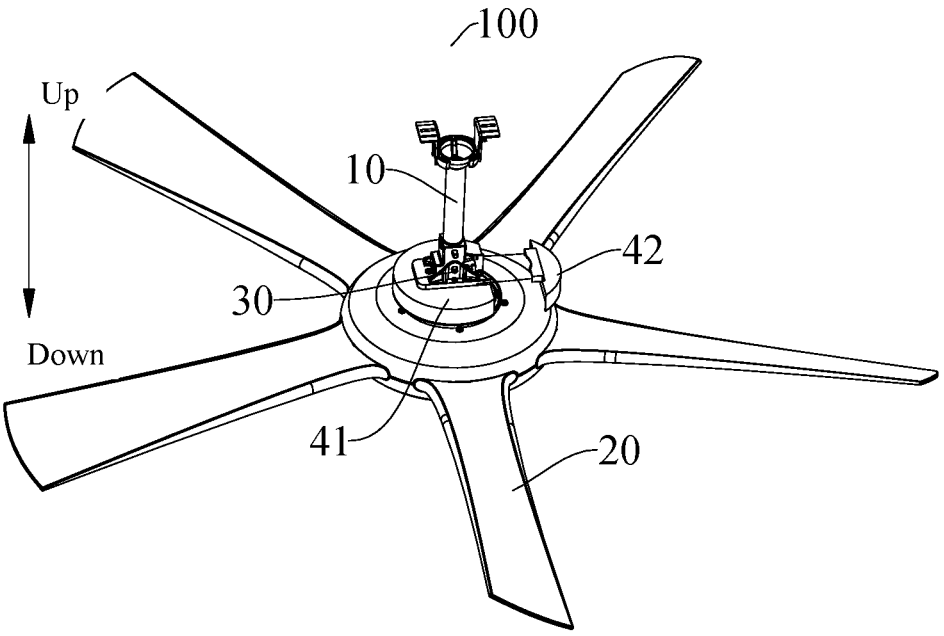
FIG. 6 is an exploded view of a receiver cover and other components of the ceiling fan assembly in FIG. 1.
Figure 7:
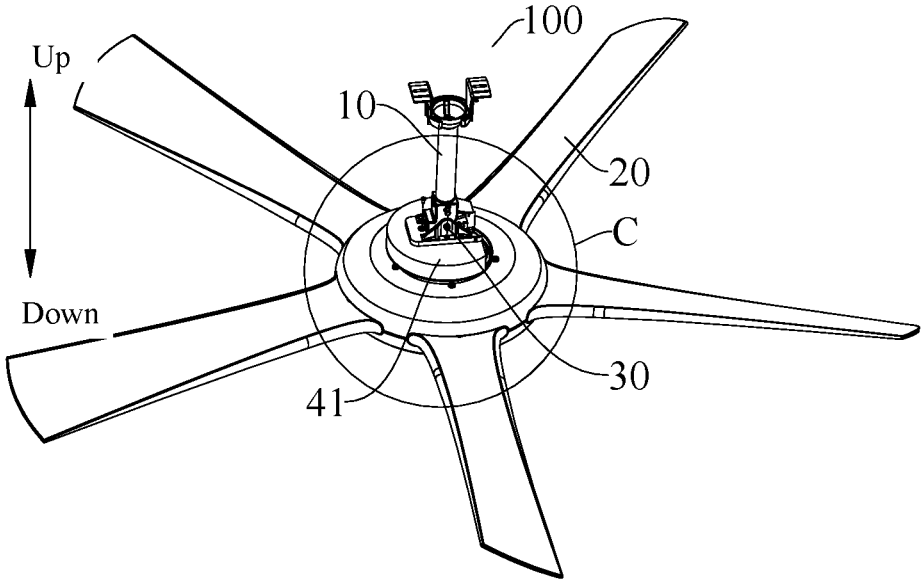
FIG. 7 is an assembly view of the ceiling fan assembly in FIG. 1.
Figure 10:
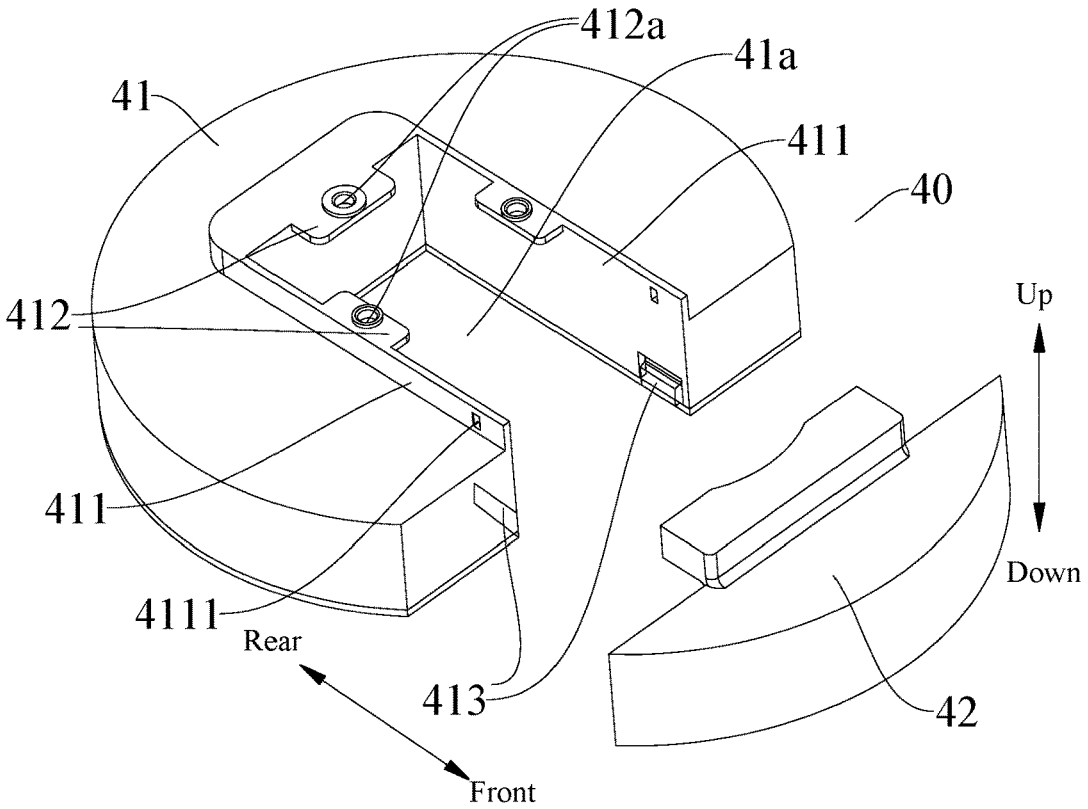
FIG. 10 is an exploded view of the receiver in FIG. 9.

Specifically, as shown in FIGS. 3, 4 and 10, the avoidance groove 41*a* is formed in a ⊏ shape with the opening, and the three side walls of the avoidance groove 41*a* are provided with horizontal fixing plates 412 extending along the radial direction of the downrod 10. Each of the fixing plates 412 is provided with at least one first mounting hole 412*a*, while the connector base 30 is provided with at least three second mounting holes 30*a* spaced apart from one another. The receiver body 41 and the connector base 30 are fixedly connected through at least three fastening pieces, so as to further ensure the reliability of the connection between the receiver body 41 and the connector base 30. Optionally, the fastening piece is a screw, and the receiver body 41 and the connector base 30 are connected by screws, in which case the connection reliability is high, the assembly and disassembly is easy, and the replacement is convenient, thereby greatly improving production efficiency of the ceiling fan assembly 100 and reducing the cost.

Figure 8:
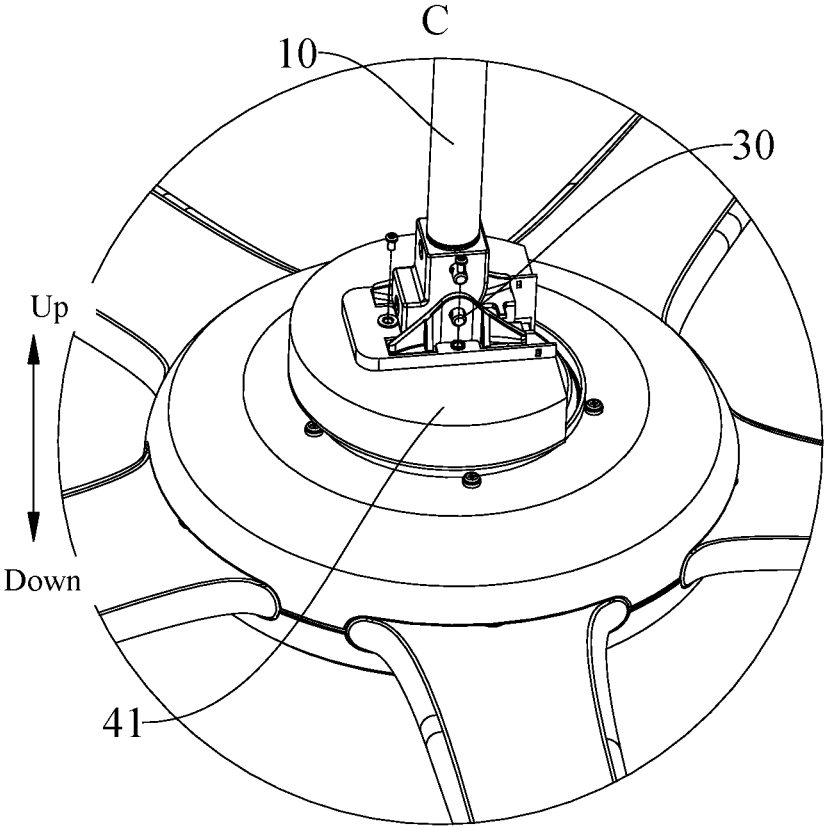
FIG. 8 is an enlarged view of part C in FIG. 7.

As shown in FIGS. 4 and 8, during the installation of the receiver 40, the receiver body 41 is first mounted to the connector base 30 and the downrod 10 is located in the avoidance groove 41*a* of the receiver body 41; then the screw is screwed into the connector base 30 and the receiver body 41 to realize the fixed connection between the connector base 30 and the receiver body 41; the receiver cover 42 is snap-fitted with the side of the receiver body 41; finally, the receiver 40 is fitted over the connector base 30 at the lower end of the downrod 10.

According to an embodiment of the present disclosure, the two opposite side walls of the avoidance groove 41*a* which are adjacent to the opening are respectively provided with a terminal interface 413 for connection with an external circuit.

Specifically, during the installation of the receiver 40, the receiver body 41 is first mounted to the connector base 30 and the downrod 10 is located in the avoidance groove 41*a* of the receiver body 41; after the receiver body 41 and the connector base 30 are fixedly connected, a wiring terminal of the external circuit is inserted into the terminal interface 413 of the receiver body 41 to connect to the circuit; after the wiring step is completed, the receiver cover 42 is snap-fitted with the side of the receiver body 41 to close the opening of the avoidance groove 41*a* of the receiver body 41; finally, the downrod 10 is located in the mounting groove 40*a* of the receiver 40, that is, the receiver 40 is fitted over the connector base 30 at the lower end of the downrod 10.

Therefore, the ceiling fan assembly 100 is simple in structure, reliable in connection among various components, and convenient to assemble and disassemble. Meanwhile, the terminal interface 413 on the receiver body 41 facilitates the connection with the external circuit, that is, a user can directly connect a quick-connect terminal to the terminal interface 413, thereby ensuring the connection between an external power source and an electric machine, and simplifying a wiring process to achieve fast wiring and good user experience.

Figure 9:
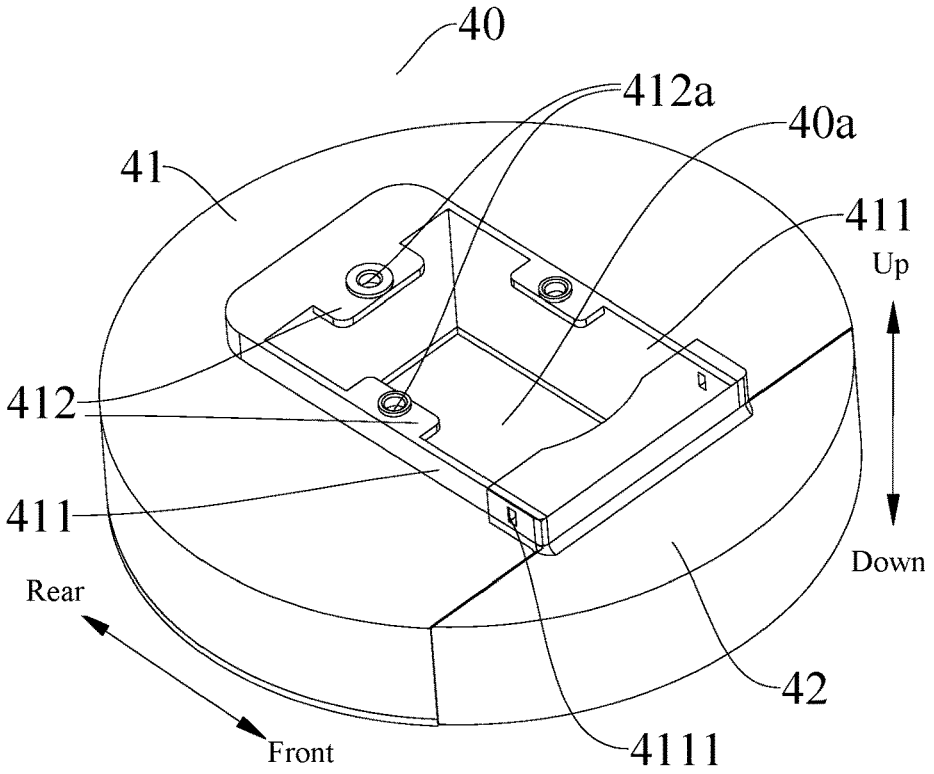
FIG. 9 is a schematic view of a receiver of a ceiling fan assembly according to an embodiment of the present disclosure.

In some specific examples of the present disclosure, the receiver body 41 is approximately U-shaped, and an outer contour of the receiver body 41 is arc-shaped. Referring to FIG. 9, the outer contour line of the receiver body 41 is formed as a major arc, an outer contour line of the receiver cover 42 is formed as a minor arc opposite the receiver body 41, and a middle portion of the receiver body 41 is provided with the ⊏-shaped groove with the opening. After the receiver 40 is assembled with the connector base 30, the receiver 40 is just fitted over the connector base 30 at the lower end of the downrod 10, ensuring a reliable connection of the receiver 40 with other components, which can guarantee both electric connection of the ceiling fan assembly 100 and aesthetic appearance of the ceiling fan assembly 100.

In some embodiments, an outer contour line of the receiver 40 is formed as a circle. After the receiver body 41 and the receiver cover 42 are sequentially assembled with the connector base 30, a central axis of the receiver 40 is arranged coaxial with the central axis of the downrod 10. But during the operation of the ceiling fan 20, the receiver 40 is spaced apart from the ceiling fan 20 to guarantee the normal operation of the ceiling fan 20. In this case, the receiver 40 has a simple structure and an aesthetic and novel appearance, improving the visual aesthetics of the ceiling fan assembly 100.

In some other specific embodiments of the present disclosure, a top wall of the receiver body 41 is provided with a vertical baffle 411 extending along the circumference of the avoidance groove 41*a*, and each fixing plate 412 is connected to an upper end of the vertical baffle 411.

Specifically, as shown in FIGS. 9 and 10, the side wall of the avoidance groove 41*a* of the receiver body 41 extends upwards to form the vertical baffle 411 protruding from the top wall of the receiver body 41, the vertical baffle 411 surrounds the circumference of the avoidance groove 41*a*, and the plurality of fixing plates 412 are connected to the upper end of the vertical baffle 411 and spaced apart along a circumference of the vertical baffle 411. Thus, by providing the vertical baffle 411 to the receiver body 41, the arrangement of the fixing plate 412 is convenient, thereby facilitating the connection between the receiver body 41 and the connector base 30. The vertical baffle 411 can be integrally molded with a housing of the vertical baffle 411 and the processing and manufacturing are easy.

As shown in FIG. 10, in this embodiment, the two ends of the vertical baffle 411, adjacent to the opening, are provided respectively with a snap groove 4111, and the receiver cover 42 is provided with a snap (not illustrated) snapped into the snap groove. During the installation of the receiver 40, the receiver body 41 is first mounted to the connector base 30 and the downrod 10 is located in the avoidance groove 41*a* of the receiver body 41; after the receiver body 41 and the connector base 30 are fixedly connected, the wiring terminal of the external circuit is inserted into the terminal interface 413 of the receiver body 41 to realize the connection of the circuit; after the wiring step is completed, the receiver cover 42 is snap-fitted with the side of the receiver body 41 and pushed inwards, such that the snap of the receiver cover 42 is snapped in the snap groove of the receiver body 41, thereby achieving a fixed connection between the receiver body 41 and the receiver cover 42. If the receiver 40 needs wiring maintenance, it only needs to remove the receiver cover 42 from the receiver body 41 to achieve the maintenance. The connection structure is simple and easy to assemble and disassemble, process, and manufacture, and has high connection reliability. Certainly, the present disclosure is not limited thereto, and the receiver cover 42 and the receiver body 41 can be fixedly connected through other connection structures.

Other constructions and operations of the ceiling fan assembly 100 according to embodiments of the present disclosure are well known to those skilled in the art and will not be elaborated in detail.

In the specification, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience of description and do not indicate or imply that the device or element referred to must have a particular orientation or must be constructed or operated in a particular orientation. Thus, these terms cannot be constructed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments are exemplary and cannot be construed to limit the present disclosure, and changes, modifications, alternatives and variants can be made in the embodiments without departing from spirit, principles and scope of the present disclosure.

What is claimed is:

1. A ceiling fan assembly, comprising:

a downrod;

a ceiling fan connected to a lower end of the downrod;

a connector base mounted to the downrod and located above the ceiling fan;

a receiver having an internal mounting groove penetrating the receiver in an up-and-down direction, the receiver being located at a periphery of a central axis of the downrod and detachably connected to the connector base;

a receiver body defining an avoidance groove with an opening, and includes a first portion of a first connector; and a receiver cover that includes a second portion of the first connector and is disposed to a side of the receiver body to close the opening of the avoidance groove and cooperating with the receiver body to define the internal mounting groove, wherein the receiver cover connected to the receiver body when the first portion of the first connector and the second portion of the first connector are coupled in a snapping manner, wherein:

side walls of the avoidance groove are provided with a plurality of fixing plates spaced apart along a circumference of the avoidance groove; each of the fixing plates is provided with a respective first mounting hole; and the connector base is provided with a plurality of second mounting holes each in a one-to-one correspondence with a corresponding first mounting hole.

2. The ceiling fan assembly according to claim 1, wherein the avoidance groove is approximately ⊏ -shaped; three side walls of the avoidance groove are provided with the fixing plates extending inwards in a radial direction of the downrod; and the fixing plates are connected to the connector base.

3. The ceiling fan assembly according to claim 1, wherein opposite side walls of the avoidance groove which are adjacent to the opening are respectively provided with a terminal interface for connection with an external circuit.

4. The ceiling fan assembly according to claim 1, wherein the receiver body and the connector base are connected by a screw.

5. The ceiling fan assembly according to claim 1, wherein the receiver body is approximately U-shaped, and an outer contour of the receiver body is formed to be arc-shaped.

6. The ceiling fan assembly according to claim 1, wherein a top wall of the receiver body is provided with a vertical baffle extending along the circumference of the avoidance groove, and each fixing plate is connected to an upper end of the vertical baffle.

7. The ceiling fan assembly according to claim 6, wherein two ends of the vertical baffle, adjacent to the opening, are provided respectively with a snap groove that serves as the first portion of the first connector, and the receiver cover is provided with a snap that serves as the second portion of the first connector and is snapped into the snap groove.

8. The ceiling fan assembly according to claim 1, wherein an outer contour line of the receiver is formed as a circle.

* * * * *